United States Patent [19]

Roche

[11] 4,410,836

[45] Oct. 18, 1983

[54] VOLTAGE LIMITED BALLAST FOR GASEOUS DISCHARGE DEVICES

[75] Inventor: William J. Roche, Merrimac, Mass.

[73] Assignee: GTE Products Corporation, Stamford, Conn.

[21] Appl. No.: 308,303

[22] Filed: Oct. 5, 1981

[51] Int. Cl.[3] ..... H05B 41/14

[52] U.S. Cl. ..... 315/96; 315/101; 315/122; 315/189; 315/201

[58] Field of Search ..... 315/96, 99, 101, 105, 315/122, 200 R, 201, 189, 324, DIG. 5, 232, 250, 323; 328/7; 307/326

[56] References Cited

U.S. PATENT DOCUMENTS 4,122,375 10/1978 Studli ..... 315/101 X

*Primary Examiner*—Eugene R. Laroche

*Attorney, Agent, or Firm*—Thomas H. Buffton

[57] ABSTRACT

A ballast apparatus for series-sequenced gaseous discharge devices includes at least one pair of series-sequenced discharge devices having series-connected filaments with a first rectifier means coupling a filament of one discharge device to the transformer and a second rectifier means coupling the series-connected filaments to the transformer whereby current flow is inhibited until both discharge devices are secured in the fixtures and dangerous socket-to-ground voltages are prevented during discharge device installation.

15 Claims, 4 Drawing Figures

VOLTAGE LIMITED BALLAST FOR GASEOUS DISCHARGE DEVICES

A concurrently filed application Ser. No. 308,295 entitled "Series-Connected Discharge Device Ballast Apparatus," in the name of the present inventor and assigned to the Assignee of the present disclosure, relates to ballast apparatus for series-connected series-sequenced discharge devices.

TECHNICAL FIELD

This invention relates to ballast lamp systems for series-sequenced gaseous discharge devices and more particularly to a voltage limited ballast lamp system for series-sequenced gaseous discharge devices wherein the filaments are series-connected.

BACKGROUND ART

At present, ballast apparatus for series-sequenced gaseous discharge devices, such as T-12 fluorescent lamps, for example, usually includes a transformer coupled to a potential source and to the ends of the series-sequenced gaseous discharge devices. A filament from each one of the series-sequenced lamps is connected in parallel, and these parallel connected filaments are coupled to the transformer. Frequently, a starting capacitor is shunted across one of the pair of series-sequenced gaseous discharge devices in order to provide an increased open circuit starting potential for initiating conduction in one of the discharge devices and, subsequently, effecting energization of the other discharge device.

Although the above-described apparatus has been and still is utilized in numerous present day applications, T-12 ballast-lamp systems for example, it has been found that there are other applications wherein such apparatus leaves something to be desired. More specifically, other applications have been found wherein an increased open circuit starting voltage capability is a necessity. This added voltage capability must be designed into the ballast circuit in such a manner as to satisfy existing Underwriters Laboratories (UL) voltage limitations on socket-to-ground voltage.

One attempt to alleviate undesired excess socket-to-ground voltages is suggested in U.S. Pat. No. 4,185,231, issued Jan. 22, 1980 in the name of Colliton. Therein, a starting capacitor shunts one of a pair of series-sequenced gaseous discharge devices and a resistor is shunted across the starting capacitor and allegedly decreases undesired peak voltages appearing between the socket of a discharge device and circuit ground. However, it is obvious that the addition of a power consuming device, such as a resistor, is costly and even more significantly causes an undesired and expensive loss of power.

OBJECTS AND SUMMARY OF THE INVENTION

An object of the present invention is to provide an improved ballast apparatus for gaseous discharge devices. Another object of the invention is to provide ballast apparatus having enhanced efficiency. A further object of the invention is to provide an improved ballast apparatus having an increased starting voltage capability and socket-to-ground voltages acceptable under Underwriters Laboratories (UL) standards. A still further object of the invention is to provide ballast apparatus wherein the filaments of the discharge devices act as safety interlocks inhibiting undesired excess socket-to-ground voltages.

These and other objects, advantages and capabilities are achieved in one aspect of the invention by ballast apparatus wherein a transformer is coupled by a first rectifier means to a pair of series-sequenced gaseous discharge devices with a starting capacitor shunting one of the gaseous discharge devices and by way of a second rectifier means to a pair of series-connected filaments of the series-sequenced gaseous discharge devices whereby the filaments of the gaseous discharge devices function as safety interlocks to limit the voltage difference between the sockets of the gaseous discharge devices and circuit ground.

BEST MODE FOR CARRYING OUT THE INVENTION

For a better understanding of the present invention, together with other and further objects, advantages and capabilities thereof, reference is made to the following disclosure and appended claims in conjunction with the accompanying drawings.

Figure 1:
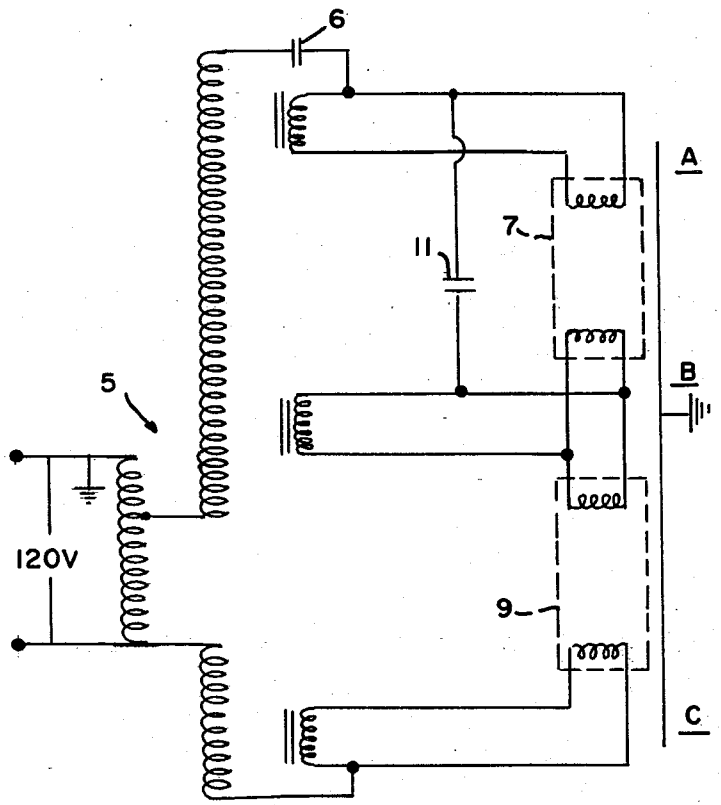
FIG. 1 is a ballast apparatus configuration having increased open circuit starting voltages but susceptible under certain conditions to undesirable excessive socket-to-ground voltages.

Referring to the drawings, FIG. 1 illustrates a ballast apparatus having an increased open voltage starting capability. Therein, a transformer 5 is coupled to a potential source (not shown) and by way of a power capacitor 6 to a pair of series-sequenced gaseous discharge devices 7 and 9. A starting capacitor 11 shunts one of the gaseous discharge devices 7, and a filament of each of the gaseous discharge devices 7 and 9 is parallel-connected and coupled to the transformer 5.

Although the above-described ballast apparatus did provide an open circuit starting voltage of an amount sufficient to energize a more demanding lamp, such as a T-8 fluorescent lamp for example, and also presented socket-to-ground voltages within the accepted standards of the Underwriters Laboratories (UL), it was found the problems still existed. More specifically, it was found that removal or failure of the gaseous discharge device 7, shunted by the starting capacitor 11, permitted an AC current path which includes the power transformer 5, power capacitor 6, starting capacitor 11 and the other gaseous discharge device 9.

Under the above-described conditions, it was found that the AC current path tended to provide a quasi-resonant circuit causing a peak voltage and an rms voltage between the sockets of the shunted gaseous discharge device 7 and circuit ground which exceeds the maximum limits set forth by the Underwriters Laboratories (UL). Thus, UL approval of the ballast-lamp apparatus under such conditions would not be forthcoming and marketplace acceptance without such approval would be most unlikely, if not impossible.

Figure 2:
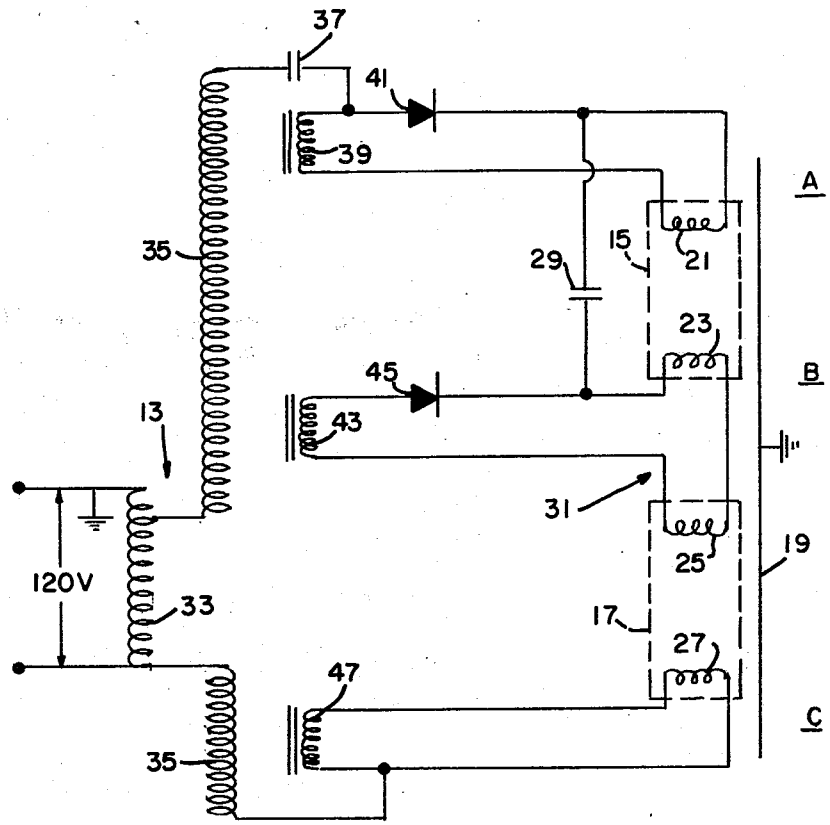
FIG. 2 is a preferred embodiment of a ballast apparatus for series-sequenced gaseous discharge devices.

However, the above-described undesired deficiency is essentially eliminated by the preferred embodiment of FIG. 2. Herein, a transformer 13, in an autotransformer configuration, is coupled to a pair of series-sequenced low pressure gaseous discharge devices 15 and 17. These gaseous discharge devices 15 and 17 are located, in the usual manner, adjacent a grounded member 19 of a lighting fixture. Also, each one of the discharge devices 15 and 17 has a pair of filaments 21 and 23 and 25 and 27 respectively.

One of the gaseous discharge devices 15 is shunted by a starting capacitor 29, and a circuit means 31 series-connects the filaments 23 and 25 of the pair of discharge devices 15 and 17.

Referring to the transformer 13, a primary winding 33 is connected to a potential source (not shown) such as a 120-volt AC source, for example, and to a secondary winding 35. This secondary winding 35 is coupled by way of a power capacitor 37 to the junction of a first filament winding 39 and a first diode 41. The first diode 41, in turn, is connected to a filament 21 of the discharge device 15 with the filament 21 connected to the first filament winding 39.

A second filament winding 43 of the transformer 13 is coupled by a second diode 45 to the circuit means 31 series-connecting the filaments 23 and 25 of the pair of discharge devices 15 and 17 respectively. A third filament winding 47 is connected to the secondary winding 35 of the transformer 13 and to the filament 27 of the other one of the gaseous discharge devices 17.

As to operation, it is to be noted that the common filaments 23 and 25 of the discharge devices 15 and 17 must be in series-connection rather than the more common parallel connection. Otherwise, the filaments 23 and 25 of the discharge devices 15 and 17 would serve to bypass or shunt the second diode 45 and, in turn, defeat the blocking action of the second diode 45 as will be explained hereinafter.

As previously explained with the circuit configuration of FIG. 1, an AC quasi-resonant circuit path by way of the transformer 5, power capacitor 6, starting capacitor 11 and gaseous discharge device 9 was present when the one discharge device 7 was removed, and the small AC current present in this configuration resulted in undesired high peak and rms voltages between the sockets of the one discharge device 7 and circuit ground. Thus, UL voltage standards were exceeded and an unapproved product resulted.

However, it can be seen that the embodiment of FIG. 2 negates this condition by eliminating the AC current path. For example, removal of the gaseous discharge device 15 prevents AC current flow from the transformer secondary 35 via the power capacitor 37 and starting capacitor 29, by the full cycle blocking action of diodes 41 and 45. In this manner, filaments 21 and 23 of lamp 15 function as safety interlocks which allow circumvention of diodes 41 and 45 only after both filaments 21 and 23 of lamp 15 are fully engaged in their respective sockets. Obviously, it is noted that the series-connected circuit means 31, which replaces the usual parallel-connected filaments, is necessary to prevent shunting of the second diode 45 by the filament 25 of the discharge device 17.

Additionally, it is to be noted that the above-described embodiment is also appropriate to the disconnection of either one of the filaments 21 or 23 of the shunted discharge device 15. For instance, removal of either the filament 21 or 23 of the discharge device 15 results in a DC starting circuit, due to the first and second diodes 41 and 45 respectively, and a resultant blocking action by the capacitors 29 and 37. As a result, the previously-mentioned quasi-resonant current path is no longer available and the undesired relatively high socket-to-ground voltages are eliminated.

It should be also noted that components appropriate to the above-described circuitry are readily available in the marketplace. For example, apparatus utilizing a pair of 48-inch T-8 lamps would utilize a starting capacitor 29 having a value of about 0.1 microfarads with a 400-volt rating. Also, the diodes, 41 and 45 respectively, are ordinary silicon diodes having a 400-volt 1-ampere rating and readily available from Motorola, General Electric or any one of numerous semi-conductor manufacturers. Moreover, the first filament winding 39 would be formed to provide a voltage of about 6.1 volts to compensate for the first diode 41 and provide about 3.7 volts at the filament 21 of the discharge device 15. Further, the second filament winding 43 would be formed to provide about 11.4 volts to compensate for the second diode 45 and again provide about 3.7 volts across each of the series-connected filaments 23 and 25. The third filament winding 47 need only provide the usual 3.7 volts at the filament 27.

Figure 3:
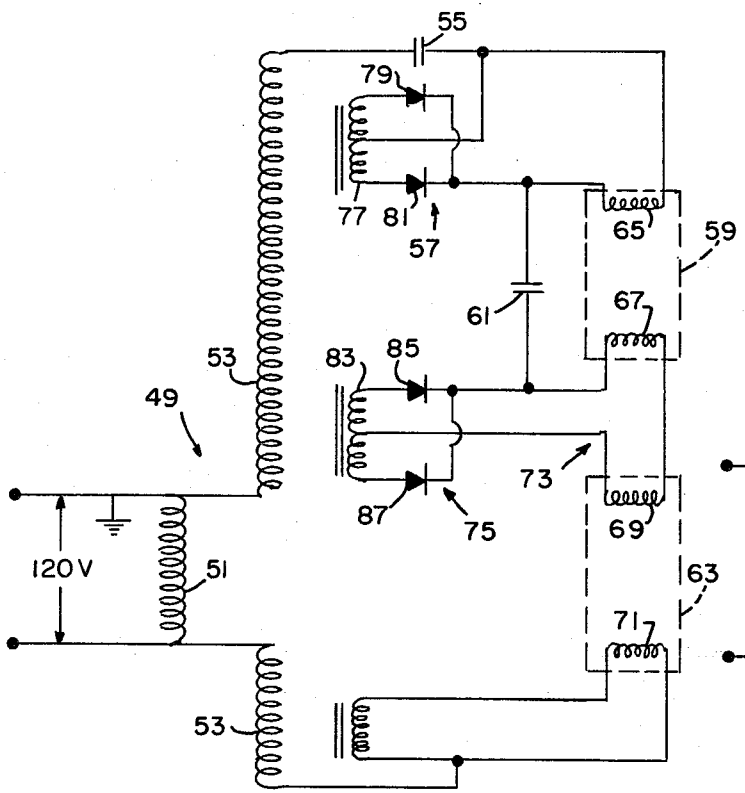

Alternatively, FIG. 3 illustrates another ballast apparatus configuration for a pair of series-sequenced gaseous discharge devices. Therein, an autotransformer 49 has a primary winding 51 coupled to an AC source (not shown) and to a secondary winding 53. One end of the secondary winding 53 is coupled by a power capacitor 55 to a first rectifier means 57 and to a first gaseous discharge device 59 which is shunted by a starting capacitor 61. The other end of the secondary winding 53 is connected to a second gaseous discharge device 63. The first discharge device 59 includes a pair of filaments 65 and 67, and the second discharge device includes a pair of filaments 69 and 71. A circuit means 73 series-connects the filaments 67 and 69 and is coupled by a second rectifier means 75 to the filament winding 83.

In this example, the first rectifier means 57 is in the form of a full-wave rectifier having a center-tapped filament winding 77 and diodes, 79 and 81 respectively, each coupled to one end of the center-tapped filament winding 77. Similarly, the second rectifier means 75 includes a center-tapped filament winding 83 coupled to the circuit means 73 with a pair of diodes, 85 and 87, each coupled to one end of the filament winding 83 and to the circuit means 73. Thus, a full-wave rectifier configuration provides power to the filaments 65, 67 and 69 of the discharge devices 59 and 63.

Figure 4:
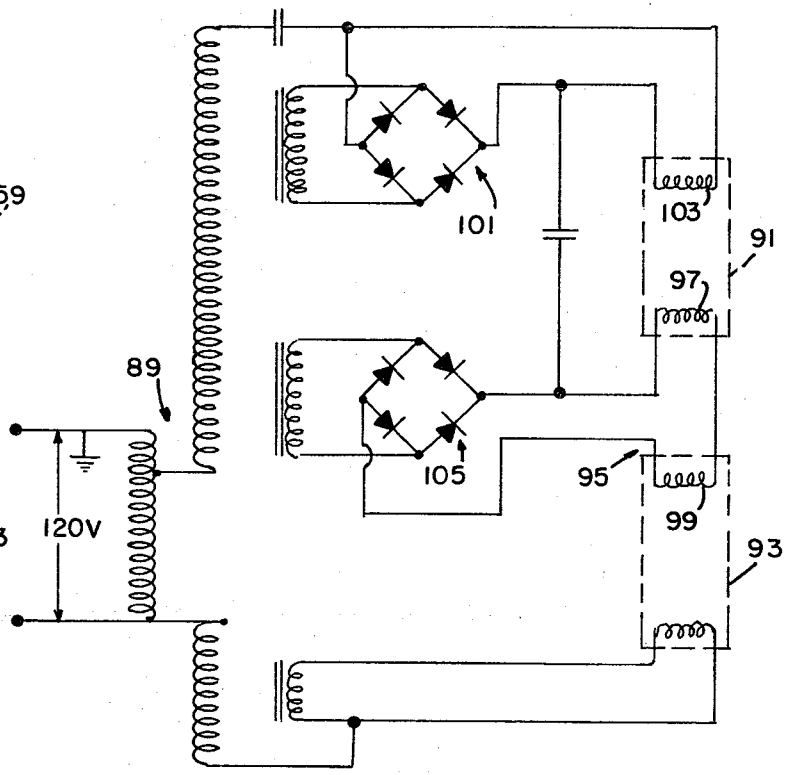
FIGS. 3 and 4 are alternate embodiments of the ballast apparatus of FIG. 2.

Further, another embodiment is illustrated in FIG. 4. Herein, an autotransformer 89 is coupled to series-sequenced gaseous discharge devices 91 and 93 having a circuit means 95 providing series-connected filaments 97 and 99. A first rectifier means 101 is in the form of a full-wave diode bridge and is coupled to a filament 103 of the discharge device 91. A second rectifier means 105 is also in the form of a full-wave diode bridge and is coupled to the circuit means 95 series-connecting the filaments 97 and 99.

Accordingly, tests were conducted with a non-diode configuration, illustrated in FIG. 1, and a diode-modified ballast apparatus, illustrated in FIG. 2. A 0.1 microfarad 400-volt starting capacitor 11 and 29 was employed with a single 48-inch T-8 fluorescent gaseous discharge device 9 and 17 respectively. Moreover, the transformer windings 39 and 43 were modified to compensate for the presence of the diodes 41 and 45.

In comparison tests the open-circuit rms voltage measured across the sockets A and C of the embodiment of FIGS. 1 and 2 was substantially the same of about 315 volts. The rms voltage measured from the socket A to circuit ground for both FIGS. 1 and 2 was about 173 volts rms which is well within the UL limits of 180 volts rms. However, the rms voltage from the socket B to circuit ground measured about 195 volts rms on the embodiment of FIG. 1 and zero on FIG. 2 with the UL standard set at 180 volts rms. Thus, the prior art configuration of FIG. 1 fails to meet the standard. Moreover, the peak voltage at sockets A and B of FIG. 1 were measured as 420 volts and 440 volts respectively, while FIG. 2 measured 300 volts peak voltage at socket A and zero at socket B. Since the UL standard is a maximum of 325 volts peak voltage at either socket A or B, it is obvious that the prior art configuration fails to comply while the embodiment of FIG. 2 is well within recognized voltage limitations as established by Underwriters Laboratories standards.

While there have been shown and described what is at present considered the preferred embodiments of the invention, it will be obvious to those skilled in the art that various modifications and changes may be made therein without departing from the invention as defined by the appended claims.

INDUSTRIAL APPLICABILITY

An enhanced ballast apparatus for series-sequenced gaseous discharge devices includes a rectifier means whereby current flow is inhibited unless both lamps are secured in the fixture sockets. Thus, the filaments of the lamps function as interlocks to prevent potentially dangerous socket-to-ground voltages during installation or removal of the lamps. The apparatus utilizes series-connected filaments which simplifies and reduces the cost of installation for series-sequenced gaseous discharge devices. Moreover, the improved safety conditions encountered during installation of the discharge devices is an advangage of unmeasurable value in both initial and replacement discharge device installation procedures.

I claim:

1. A ballast apparatus for starting and operating at least one pair of series-sequenced low pressure gaseous discharge devices comprising a starting capacitor shunting one of said pair of discharge devices and a transformer coupled to a potential source, said apparatus characterized by the improvement comprising a first rectifier means coupling one end of said pair of discharge devices to said transformer, circuit means series connecting a filament of each of said pair of discharge devices, a second rectifier means coupling said circuit means to said transformer and said transformer directly coupled to the other end of said pair of discharge devices.

2. The ballast apparatus of claim 1 including a power capacitor coupling said first rectifier means to said transformer.

3. The ballast apparatus of claim 1 wherein each of said first and second rectifier means is in the form of a diode.

4. The ballast apparatus of claim 1 wherein said transformer is in the form of an autotransformer having a primary winding coupled to a potential source and a secondary winding having one end coupled by a series-connected power capacitor and first rectifier means to one end of said pair of series-sequenced low pressure gaseous discharge devices and the other end of said secondary winding directly coupled to the other end of said pair of discharge devices.

5. The ballast aparatus of claim 1 wherein said transformer includes a first filament winding coupled by a first diode to one end of said pair of series-sequenced low pressure gaseous discharge devices, a second filament winding coupled by a second diode to said circuit means series-connecting said filaments of said pair of discharge devices and a third filament winding directly connected to the other end of said pair of series-sequenced discharge devices.

6. The ballast apparatus of claim 1 wherein at least one of said first and second rectifier means is in the form of a full-wave rectifier means.

7. The ballast apparatus of claim 1 wherein at least one of said first and second rectifier means is in the form of a full-wave rectifier having a center-tapped filament winding.

8. The ballast apparatus of claim 1 wherein at least one of said first and second rectifier means is in the form of a full-wave diode bridge.

9. The ballast apparatus of claim 1 wherein said transformer includes a first filament winding coupling by a first diode to one end of said pair of series-sequenced low pressure gaseous discharge devices and providing a voltage of about 6.1 volts, a second filament winding coupled by a second diode to said series-connected filaments of said pair of discharge devices and providing a voltage of about 11.4 volts and a third filament winding directly connected to the other end of said pair of series-sequenced discharge devices and providing a voltage of about 3.7 volts whereby a voltage of about 3.7 volts is applied to each filament of said pair of series-sequenced discharge devices.

10. A ballast apparatus for starting and operating a pair of series-sequenced gaseous discharge devices comprising a starting capacitor shunting one of said pair of discharge devices and a transformer coupled to a potential source and directly connected to the other one of said pair of discharge devices with said apparatus characterized by the improvement wherein a first diode couples said discharge device shunted by said starting capacitor to said transformer, a filament of each one of said pair of discharge devices is connected in series, and a second diode couples said series-connected filaments of said discharge devices to said transformer.

11. The ballast apparatus of claim 10 wherein said transformer includes a first filament winding coupled to said one discharge device by said first diode, a second filament winding coupled by said second diode to said series-connected filaments of said discharge devices and a third filament winding connected to said other one of said pair of discharge devices.

12. The ballast apparatus of claim 10 wherein said transformer is formed to include a first filament winding coupled by said first diode to said discharge device shunted by said starting capacitor and providing a voltage of about 6.1 volts and a second filament winding coupled by said second diode to said series-connected filaments of said pair of discharge devices and providing a voltage of about 11.4 volts whereby a voltage of about 3.7 volts is applied to each filament of said pair of discharge devices.

13. The ballast apparatus of claim 10 wherein a full-wave rectifier means couples said discharge device shunted by said starting capacitor to said transformer.

14. The ballast apparatus of claim 10 wherein a first full-wave rectifier means couples said discharge device shunted by said starting capacitor to said transformer and a second full-wave rectifier means couples said series-connected filaments of said series-sequenced pair of discharge devices to said transformer.

15. The ballast apparatus of claim 14 wherein said first and second full-wave rectifier means are each in the form of a diode connected to opposite ends of a center-tapped filament winding.

* * * * *